United States Patent [19]

Schwenzfeier et al.

[11] 4,218,029

[45] Aug. 19, 1980

[54] UPCOILER

[75] Inventors: Werner Schwenzfeier, Leoben; Thomas Neff, St. Florian; Karl Wiesbauer, St. Valentin, all of Austria

[73] Assignee: Voest-Alpine Aktiengesellschaft, Linz, Austria

[21] Appl. No.: 67,052

[22] Filed: Aug. 16, 1979

[51] Int. Cl.[2] ..... B65H 19/04

[52] U.S. Cl. ..... 242/56.9; 242/22 B; 242/78.1

[58] Field of Search ..... 242/78.1, 78.3, 78.6, 242/56.9, 72, 72 B, 67.1 R

[56] References Cited

U.S. PATENT DOCUMENTS

| | | | |
|---|---|---|---|
| 2,215,069 | 9/1940 | Meisel | 242/72 B |
| 3,878,999 | 4/1975 | Daves | 242/56.9 |
| 4,026,491 | 5/1977 | Bostroem | 242/56.9 |

*Primary Examiner*—Edward J. McCarthy
*Attorney, Agent, or Firm*—Kurt Kelman

[57] ABSTRACT

A drive shaft is surrounded by a winding drum, which consists of a plurality of axially aligned drum rings. A plurality of pressure plungers are radially slidably mounted in said shaft and radially aligned with all said drum rings and spaced apart in the peripheral and axial directions of said shaft and arranged in groups disposed in respective sectors of said shaft. Pressure-applying means for applying fluid pressure to said pressure plungers so as to force them radially outwardly against said drum rings to hold the latter clear of said shaft comprise a plurality of pressure fluid conduits for applying fluid pressure to respective groups of said pressure plungers.

7 Claims, 5 Drawing Figures

UPCOILER

Figure 1:
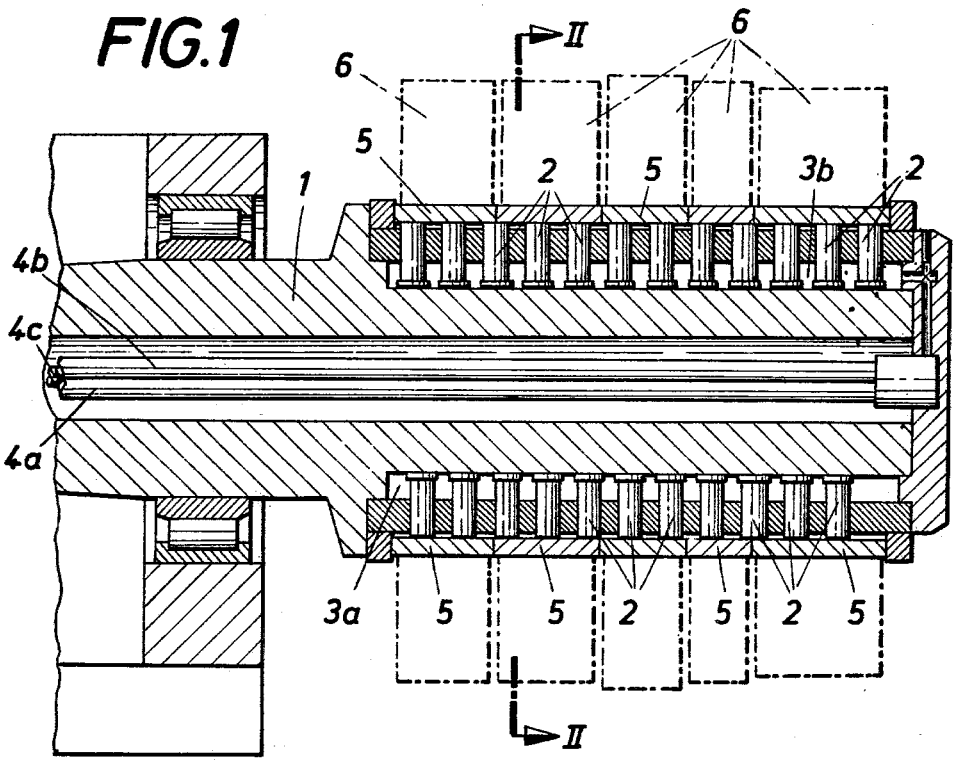

This invention relates to an upcoiler comprising a drive shaft and pressure plungers, which are adapted to be subjected to fluid pressure and radially slidably mounted in said shaft and spaced around the periphery of the shaft and along the length of the upcoiler and carry a winding drum, which surrounds the drive shaft with a clearance and consists of a plurality of individual drum rings.

When it is desired to coil individual strips formed by a longitudinally slit wide strip on a common winding drum, it will be difficult to ensure the constant strip tension which is essential for the winding of high-quality coils because the thickness of the wide strip varies over the width thereof and the wide strip is wavy in its longitudinal direction so that the narrow strips are wound under non-uniform conditions. If a given narrow strip having a larger thickness is wound up to a larger diameter than another narrow strip which is wound at the same number of revolutions per minute, such strip wound to a coil larger in diameter will be subjected to a stronger tensile force. Similar results will be obtained if the narrow strips differ in length because the wide strip that has been slit has waves in its edge portions or in the middle of its width. In that case, a longer strip will be wound up less tightly than a shorter one unless special measures are adopted.

To ensure that the coils will be identically wound although the narrow strips to be wound are irregular, it is already known to compose the winding drum of individual drum rings and to connect each drum ring by a separate friction coupling to the drive shaft of the upcoiler so that each narrow strip can be wound up independently of the others by the common drive shaft because the torque transmitted to the drum rings by the friction coupling cannot exceed a predetermined upper limit.

For the transmission of torque from the drive shaft of the upcoiler to the drum rings it is known from U.S. Pat. No. 2,215,069 to provide pressure plungers which are radially slidably mounted in the drive shaft and carry the drum rings and which by means of an inflatable flexible tube can be subjected to fluid pressure so that the pressure plungers which are spaced apart around the periphery of the shaft and over the length of the upcooler are forced outwardly against the inside peripheral surface of the drum rings and the driving torque is thus frictionally transmitted to the several drum rings. The pressure applied will then define an upper limit for the torque that can be transmitted.

These pressure plungers, which are used like pistons, provide a friction coupling between the drive shaft and the drum rings surrounding the drive shaft with a clearance. That friction coupling is simple and fully satisfactory as far as the transmission of torque is concerned. On the other hand, such an arrangement does not ensure the constant strip tension which is desired since the drum rings remain radially displaceable relative to the drive shaft to the extent of the clearance with which they surround said shaft. Because the inflatable tube acting on the pressure plungers must be resilient, a depression of the pressure plungers on one side of the shaft will cause the flexible tube to be impressed in that area and gas will then be displaced so that diametrically opposite pressure plungers will be forced radially outwardly although there is no change in pressure conditions. As a result, the drum rings float relative to the drive shaft of the extent of the clearance and the radial shifts of the drum rings during the winding of the narrow strips result necessarily in an irregular strip tension.

It is an object of the invention to avoid these disadvantages and so to improve an upcoiler of the kind described first hereinbefore that a constant strip tension can actually be ensured.

This object is accomplished according to the invention in that the pressure plungers are arranged in groups disposed in respective sectors of the shaft and the pressure plungers of each group are adapted to be subjected to fluid pressure via a pressure fluid conduit associated with said group. Because the pressure plungers are arranged in groups disposed in respective sectors of the shaft, only the pressure plungers in a single sector can be shifted at a time by causes other than a change of the fluid pressure applied. As a result, the drum rings continue to be held in position relative to the drive shaft because a shifting of the pressure plungers in one sector cannot result in a shifting of the plungers in another sector. Because the several drum rings are not freely slidable relative to the shaft to the extent of the radial clearance, such shifts cannot affect the strip tension so that the strips are wound at a constant strip tension, as is desired.

It is desired to drive each drum ring independently of the adjacent drum rings by a common drive shaft at a torque up to an upper limit. This may be accomplished in that the radially inner faces of the pressure plungers of each group protrude into a common pressure chamber, which is connected to a pressure fluid conduit. In that case, the pressure fluid is directly supplied to the pressure plungers and the same are forced against the drum rings by a force that depends only on the pressure in the pressure chamber. On the other hand, in such an arrangement each pressure plunger must be tightly and movably fitted in the guide shaft; this involves a certain expenditure.

Such tight and movable fitting of the pressure plungers will not be required if the radially inner faces of the pressure plungers of each group bear on a common flexible tube, which can be inflated by pressure fluid supplied via a pressure fluid conduit. In that case, however, it will not be possible actually to exert equal pressure forces on all pressure plungers because the flexible tube must have a certain strength so that it cannot exert uniform forces on pressure plungers shifted to different positions. The holding of the drum rings in position relative to the drive shaft will not be affected by such differential forces because only the sector-wise application of fluid pressure to the pressure plungers is essential for the purposes of the invention.

Unless a plurality of pressure fluid sources are provided for applying fluid pressure to respective groups of pressure plungers, an unobstructed exchange of pressure in respective sectors must be ensured. This can be accomplished in accordance with another feature of the invention if the pressure fluid conduits leading to respective groups of pressure plungers contain respective throttling means and are connected by a common supply conduit to a pressure fluid source. In such arrangement, a radially inwardly directed force exerted on the pressure plungers cannot directly result in a shifting of the pressure plungers because the pressure fluid that would have to be displaced by such shifting cannot be forced into another pressure plunger sector unless a resistance is overcome. As a result, any shifting of the pressure plungers in one sector will result only in a compression of the pressure fluid and the compressed pressure fluid will then exert a certain restoring force. It will be understood that the throttling means in the pressure fluid conduits leading to respective groups of pressure plungers cannot produce such blocking unless there is a change at a high rate. This fact will not involve undesired results because very gradual changes will not adversely affect the uniformity of the tensile force.

Instead of the throttling means, check valves may be provided in the pressure fluid conduits for applying fluid pressure to respective groups of pressure plungers, provided that one pressure fluid conduit must not be provided with a check valve to ensure that there will be an upper limit to the torque that can be transmitted.

To enable a venting of the pressure plungers, the throttling means or check valves are by-passed by by-pass conduits, which are adapted to be shut off. Such conduits by-passing the blocking means will be essential if they consist of check valves. The bypassing of throttles will only accelerate the venting operation.

Figure 2:
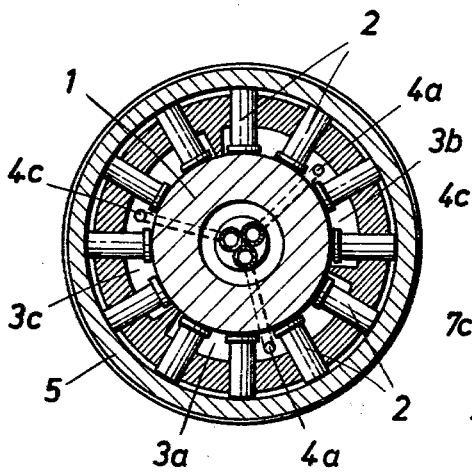
Figure 3:
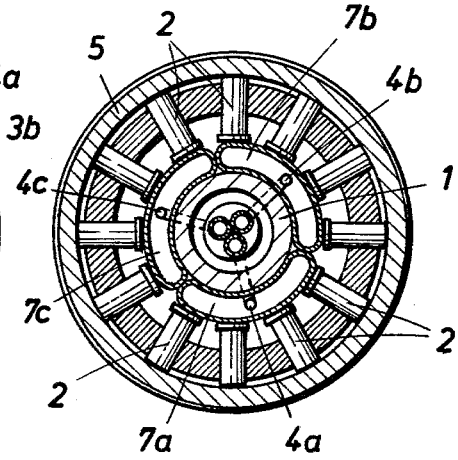
Figure 4:
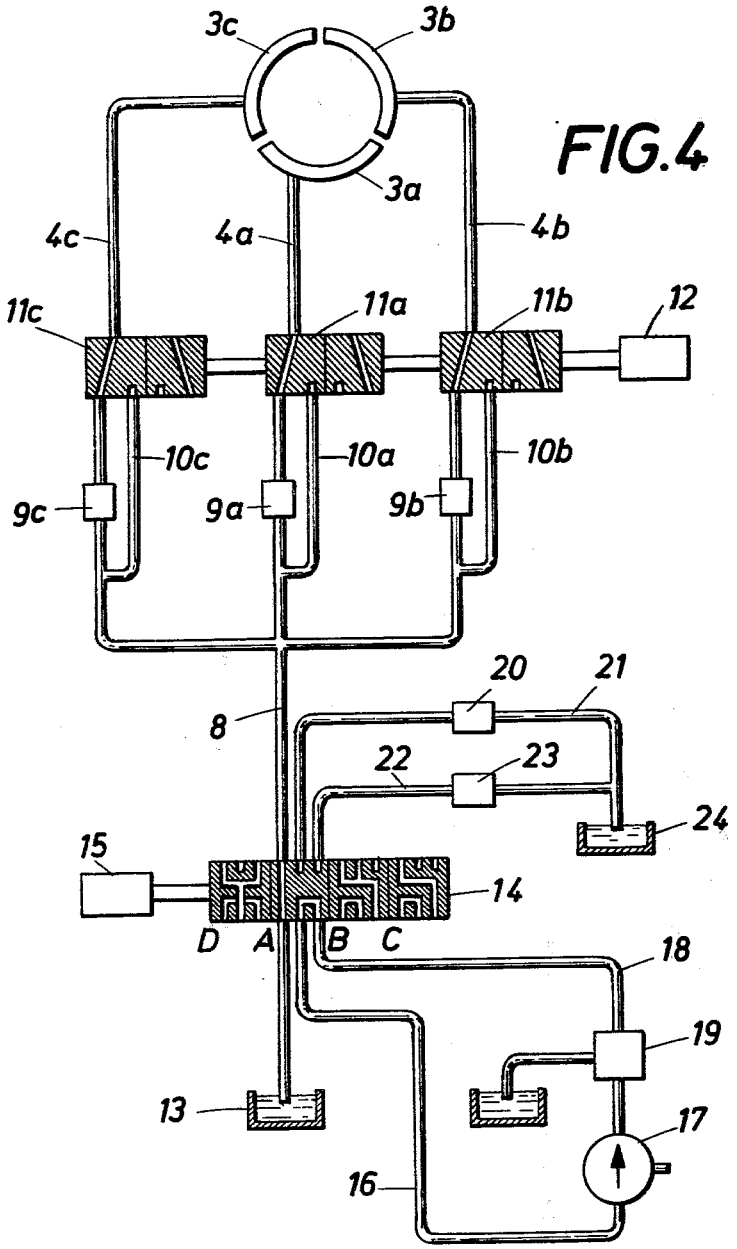
Figure 5:
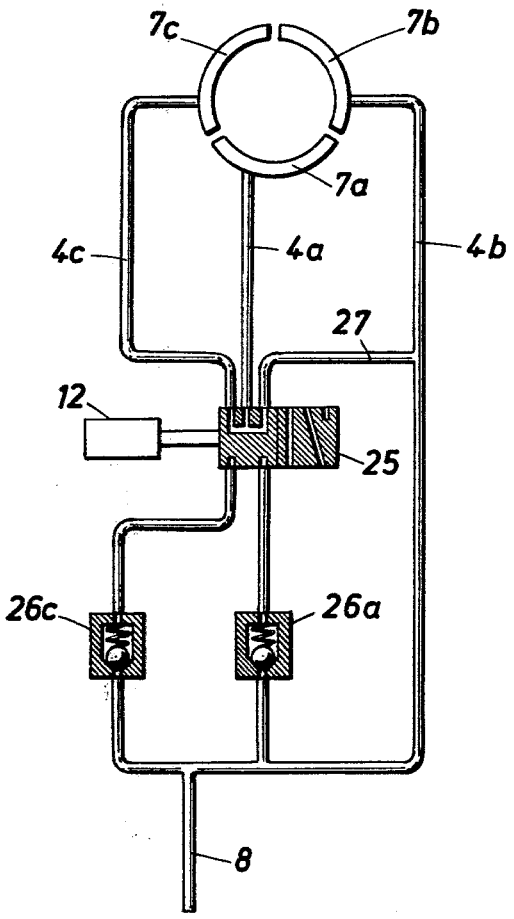

Embodiments of the invention are shown in a simplified form by way of example on the accompanying drawings, in which FIG. 1 is an axial sectional view showing an upcoiler according to the invention, FIG. 2 is a sectional view taken on line II—II in FIG. 1, FIG. 3 is a sectional view that is similar to that of FIG. 2 and shows an upcoiler comprising flexible tubes for applying pressure to the pressure plungers, FIG. 4 is a block circuit diagram showing a system for supplying pressure fluid to the groups of pressure plungers and FIG. 5 is a block circuit diagram of a system for supplying via check valves.

In the drawing, an upcoiler comprises a drive shaft 1, in which pressure plungers 2 are radially slidably fitted. The means for driving the shaft 1 are known and not shown in detail. As is shown in FIGS. 1 and 4, the pressure plungers may be subjected to fluid pressure like pistons. To that end, the radially innerfaces of the pressure plungers 2 protrude into three separate pressure chambers 3*a*, 3*b*, 3*c*, each of which is associated with a group of pressure plungers arranged in a given sector of the shaft 1. The pressure chambers 3*a*, 3*b*, 3*c* are connected to respective pressure fluid conduits 4*a*, 4*b*, 4*c*, which extend through the central cavity of the hollow drive shaft 1. When pressure is applied to the pressure plungers 2, the same are forced radially outwardly against drum rings 5, on which respective narrow strips can be wounded up to form coils 6, which are indicated in FIG. 1 by dash-dot lines. The torque that can be transmitted from the drive shaft 1 to the drum rings 5 depends on the friction conditions between the inside peripheral surface of the drum rings 5 and the outer end faces of the pressure plungers 2, on the one hand, and on the pressure applied, on the other hand. If the load applied to a given drum ring 5 due to the strip tension exceeds the upper torque limit, said drum ring 5 will slip independently of the remaining drum rings so that the pressure applied to the pressure plungers 2 will actually define an upper torque limit. It will be understood that the several narrow strips cannot be wound to form uniform coils unless the drive shaft 1 is driven at such a speed that the required strip tension is ensured also as regards those drum rings 5 which do not slip relative to the shaft 1.

To ensure that the pressure plungers 2 can act on the drum rings 5 on a sufficiently large area even when the drum rings differ in width, the pressure plungers 2 are desirabley spaced apart along helical lines. This is not apparent from the simplified drawings.

The embodiment shown in FIG. 3 differs from the embodiment shown in FIGS. 1 and 2 only in that the pressure plungers 2 are not directly supplied, like pistons, with the pressure fluid, but the latter is supplied to three inflatable flexible tubes 7*a*, 7*b* and 7*c*, which are connected to respective pressure fluid conduits 4*a*, 4*b*, 4*c*. Via these flexible tubes 7*a*, 7*b*, 7*c*, pressure is applied to the pressure plungers 2 of respective groups, which are arranged in respective sectors so that changes in one sector cannot exert a direct influence on another sector. In order to preclude a direct influence between the flexible tubes 7*a*, 7*b* and 7*c*, radial partitions may be provided between the flexible tubes. These radial partitions are not shown in FIG. 3 for the sake of clearness.

A hydraulic system for supplying pressure fluid to the pressure chambers 3*a*, 3*b* and 3*c* is illustrated in FIG. 4, which shows pressure fluid conduits 4*a*, 4*b* and 4*c*, which lead from a common supply conduit 8 to respective pressure chambers 3*a*, 3*b* and 3*c* and contain respective throttling means 9*a*, 9*b* and 9*c*. These throttling means prevent a direct influence of a pressure change in one of the pressure chambers 3*a*, 3*b*, 3*c* on the other pressure chambers and thus ensure that the several drum rings will be hydraulically held in position relative to the drive shaft. To permit of a venting or pressure relief, each throttling means 9 is by-passed by a by-pass conduit 10*a*, 10*b* or 10*c*, which can be shut off by one of the sliding valves 11*a*, 11*b* or 11*c*, respectively, when the latter are in the position shown in FIG. 4. When the sliding valves 11*a*, 11*b*, 11*c* have been moved by a common actuator 12 to the other control position, they interrupt the connection between the pressure fluid conduits 4*a*, 4*b*, 4*c* and the throttling means 9*a*, 9*b*, 9*c* and open the connection to the by-pass conduits 10*a*, 10*b* and 10*c*. The pressure fluid can now flow off freely via the supply conduit 8 into a reservoir 13 if the sliding valve 14 contained in the supply conduit 8 is in the position shown on the drawing. When it is desired to supply pressure fluid to the pressure chambers 3*a*, 3*b*, 3*c*, the sliding valve 14 is moved by an actuator 15 from the position A shown on the drawing to the position B, in which the suction conduit 16 of the pump 17 is connected to the reservoir 13 for the hydraulic fluid and the discharge conduit 18 of the pump 17 is connected to the supply conduit 8. The hydraulic fluid can now be pumped from the reservoir 13 via an adjustable pressure-limiting valve 19 into the supply conduit 8 and flows from the latter through the throttling means 9*a*, 9*b*, 9*c* to the pressure chambers 3*a*, 3*b*, 3*c*. It will be understood that for this purpose the sliding valves 11*a*, 11*b*, 11*c* must be moved to the position shown on the drawing. Because the upper torque limit depends on the pressure applied to the pressure plungers 2, that pressure applied is preferably adjustable. This is made possible by the provision of a branch conduit 21, which is adapted to be connected by the sliding valve 14 to the discharge conduit 18 of the pump 17 and contains a throttle valve 20, which determines the hydraulic pressure.

When the maximum pressure is to be applied to all pressure chambers 3*a*, 3*b* and 3*c*, the sliding valve 14 can be moved to position C, in which the branch pipe 21 is shut off from the discharge conduit 18.

In order to make possible the generation of a negative pressure in the pressure chambers 3*a*, 3*b*, 3*c* so that the pressure plungers 2 can be retracted without need for a spring bias, the sliding valve 14 may be movable to a position D, in which the suction conduit 16 of the pump 17 is connected to the supply conduit 8 and the discharge conduit 18 is connected to the reservoir 13. When the sliding valves 11*a*, 11*b*, 11*c* have been actuated to connect the by-pass conduits 10*a*, 10*b*, 10*c* to the pressure fluid conduits 4*a*, 4*b*, 4*c*, respectively, the hydraulic fluid can be pumped out of the pressure chambers 3*a*, 3*b*, 3*c* so that corresponding negative pressure can be generated in the pressure chambers. That negative pressure will be adjustable if the sliding valve 14 in position D connects the suction conduit 16 of the pump 17 to a withdrawing conduit 22, which communicates via a throttle valve 23 with a hydraulic fluid reservoir 24. The position of the throttle valve 23 will then determine the rate at which hydraulic fluid is withdrawn from the reservoir 24 and this rate will control the flow rate in the supply conduit if the pump 17 has a predetermined capacity.

The system for supplying pressure fluid to the pressure plungers 2 shown in FIG. 5 differs somewhat from the system shown in FIG. 4. Just as in FIG. 4, the supply conduit 8 may be connected to a pressure fluid source, such as a compressed-air source. To inflate the flexible tubes 7*a*, 7*b*, 7*c*, a sliding valve 25 is moved from the position shown in FIG. 5 to its other control position, in which the pressure fluid conduits 4*a* and 4*c* are connected by check valves 26*a* and 26*c* to the supply conduit 8 and the flexible tube 7*b* communicates directly with the supply conduit 8 via the pressure fluid conduit 4*b*. In this arrangement too, the drum rings 5 will be held in position relative to the drive shaft 2 because the check valves 26*a* and 26*c* can prevent a pressure relief of the flexible tubes 7*a* and 7*c*. When the sliding valve 25 is moved by the actuator 12 to its initial position shown in FIG. 5, the check valves 26*a* and 26*c* will be shunted by a common by-pass conduit 27, which opens into the pressure fluid conduit 4*b* so that the pressure built up in flexible tubes 7*a*, 7*b*, 7*c* can be properly relieved.

It will be understood that a hydraulic fluid may be used to apply pressure to the pressure plungers shown in FIG. 5 and that the system shown in FIG. 4 may alternatively be operated with compressed air. Besides, the by-pass conduits 10*a*, 10*b*, 10*c* in FIG. 4 may be replaced by a single by-pass conduit, as shown in FIG. 5, if the three sliding valves 11*a*, 11*b* and 11*c* are replaced by a common sliding valve.

What is claimed is:

1. An upcoiler, comprising a drive shaft, a winding drum, which consists of a plurality of axially aligned drum rings surrounding said shaft, a plurality of pressure plungers, which are radially slidably mounted in said shaft and radially aligned with all said drum rings and spaced apart in the peripheral and axial directions of said shaft and arranged in groups disposed in respective sectors of said shaft, and pressure-applying means for applying fluid pressure to said pressure plungers so as to urge them radially outwardly against said drum rings to hold the latter clear of said shaft, said pressure-applying means comprising a plurality of pressure fluid conduits for applying fluid pressure to respective groups of said pressure plungers.

2. An upcoiler as set forth in claim 1, in which said pressure-applying means define a plurality of pressure chambers, which are connected to respective ones of said pressure fluid conduits and associated with the pressure plungers of respective ones of said groups and each of said pressure plungers has a radially inner face disposed in the pressure chamber which is associated with the group to which the pressure plunger belongs.

3. An upcoiler as set forth in claim 1, in which said pressure-applying means comprise a plurality of flexible tubes which are disposed in said shaft and adapted to be inflated by a pressure fluid and associated with respective ones of said groups of pressure plungers, said pressure fluid conduits communicate with respective ones of said flexible tubes, and each of said pressure plunger has a radially end inner face which engages the flexible tube which is associated with the group to which the pressure plunger belongs.

4. An upcoiler as set forth in claim 1, in which said pressure-applying means comprise a pressure fluid source and a supply conduit connecting said pressure fluid source to all said pressure fluid conduits and each of said pressure fluid conduits comprises throttling means.

5. An upcoiler as set forth in claim 4, which comprises by-pass conduit means adapted to by-pass said throttling means and shut-off valve means for shutting off said by-pass conduit means.

6. An upcoiler as set forth in claim 1, in which said pressure-applying means comprise a pressure fluid source and a supply conduit connecting said pressure fluid source to all said pressure fluid conduits and all but one of said pre-ssure fluid conduits contain respective check valves, which prevent a flow of fluid in a direction from said pressure fluid conduit to said supply conduit.

7. An upcoiler as set forth in claim 6, which comprises by-pass conduit means adapted to by-pass said check valves and shut-off valve means for shutting off said by-pass conduit means.

* * * * *